US006216307B1

(12) United States Patent
Kaleta et al.

(10) Patent No.: US 6,216,307 B1
(45) Date of Patent: Apr. 17, 2001

(54) HAND HELD CLEANING DEVICE

(75) Inventors: Bryan Kaleta, Darien; Mark Kaleta, Riverside, both of IL (US)

(73) Assignee: CMA Manufacturing Co., Maywood, IL (US)

( * ) Notice: Subject to any disclaimer, the term of this patent is extended or adjusted under 35 U.S.C. 154(b) by 0 days.

(21) Appl. No.: 09/161,080

(22) Filed: Sep. 25, 1998

(51) Int. Cl.[7] ..... A47L 13/12; A47L 13/144

(52) U.S. Cl. ..... 15/119.2; 15/106; 15/115; 15/118; 15/116.2

(58) Field of Search ..... 15/116.1, 106, 15/116.2, 115, 118, 119.1, 119.2

(56) References Cited

U.S. PATENT DOCUMENTS

| | | | | |
|---|---|---|---|---|
| 210,953 | * | 12/1878 | Mc Carthy | 15/119.2 |
| 2,251,384 | * | 8/1941 | Thomas | 15/119.1 |
| 2,651,069 | | 9/1953 | Hoffman . | |
| 2,730,744 | | 1/1956 | Vaughn . | |
| 2,947,014 | | 8/1960 | O'Connor . | |
| 3,008,163 | | 11/1961 | Bommer . | |
| 3,491,397 | * | 1/1970 | Hesener | 15/118 |
| 3,533,122 | * | 10/1970 | Hesener | 15/118 |
| 4,196,488 | | 4/1980 | Barry . | |

* cited by examiner

*Primary Examiner*—Randall E. Chin
(74) *Attorney, Agent, or Firm*—Knechtel, Demeur & Samlan

(57) ABSTRACT

A hand held mop, broom or scrubber device in which the cleaning head has two cleaning elements. In one embodiment, a self-wringing mop having an elongated handle with a rigid base frame assembly is attached to the bottom end. The base frame has opposite planar surfaces with a sponge element on one of the surfaces and a scrubbing element on the opposite surface. The base frame is pivotally connected to the bottom of the elongated handle such that it pivots between two positions; a first position with the sponge oriented on the floor and a second position in which the scrubbing element is positioned on the floor. An actuator mounted on the lower half of the handle has a roller mechanism and a spaced force opposing member mounted on an end thereof. When the sponge element is saturated, the user slides the actuator towards the bottom of the elongated handle. This causes the base frame assembly to pivot to an intermediary sponge wringing position and the sponge element is drawn past the roller mechanism. The sponge is compressed between the roller and base frame assembly wringing absorbed fluids from the sponge element. The sleeve is drawn back to its initial position and the base frame assembly is allowed to pivot to either of its original position or can be pivoted to another position. In another embodiment, the cleaning head has two brushes or a brush and a scrubber on the head.

56 Claims, 8 Drawing Sheets

HAND HELD CLEANING DEVICE

BACKGROUND OF THE INVENTION

This invention relates generally to floor cleaning devices and, more particularly, to a hand held mop, broom or scrubber device having two cleaning elements.

BRIEF DESCRIPTION OF THE PRIOR ART

Numerous floor cleaning devices have been invented over the years. Generally, they all provided a labor saving device in that they allowed the user to stand upright while cleaning the floor surface. Broadly classified, there are string mops, and sponge mops and brooms. The sponge mop uses a sponge for absorbing fluids and for cleaning the floor and a squeezing mechanism in order to remove water absorbed into the sponge. Most of these devices have one cleaning implement, namely, the sponge, contacting the floor. An improvement to these devices was the introduction of a scrubbing strip along one side of the sponge element. However, none of the prior devices employed a rigidly supported scrubber pad having a surface area substantially the same as the surface area of the sponge. At best, small scrubber pad strips have been employed along an edge of the sponge.

For example, one type of wringer mop is illustrated in U.S. Pat. No. 2,730,744 issued to Vaughn on Jan. 17, 1956. This design provides for the sponge element to be folded upon itself and compressed to permit the extraction of water. Similarly, in U.S. Pat. No. 2,947,014 issued to O'Connor et al. on Aug. 2, 1960, a compressible folding sponge element is also illustrated. As can be seen, neither of these devices utilized an abrasive scrubbing strip. A problem with folding the sponge is that it results in failure of the sponge along the fold area.

One mop which does utilize either a sponge element or an abrasive element is illustrated in U.S. Pat. No. 3,008,163 to Bommer on Nov. 20, 1959. In Bommer, two mop elements are separated by a flexible partition which allows the mop elements to move or flex from one orientation to another. The sponge element is drawn up between a pair of rollers in order to have absorbed liquid removed. Even though the Bommer device illustrates two different cleaning elements on the cleaning head, the flexible support between the two cleaning elements will not allow a person to apply substantial force onto the cleaning head without the cleaning elements bending. Furthermore, it is likely that one of the wringing rollers will rub or contact the floor during the cleaning operation if sufficient force is applied downwardly by the user against the cleaning element. This is due to the fact that the cleaning elements will easily flex, causing the roller to strike the floor. Another shortcoming is that a portion of the cleaning element is always in compression between the rollers. This minimizes the usable surface of the mop head. The wringing mechanism is also complex, extending outwardly from the handle, and, thus, can catch or strike objects while mopping. All of these complexities add to the cost and possible failure of the mop and its wringing mechanism.

Another mop which provides for drawing the sponge between a pair of rollers is illustrated in U.S. Pat. No. 4,196,488 to Barry which issued on Dec. 11, 1978. However, Barry does not illustrate or use an abrasive cleaning strip nor can one easily be positioned on the sponge element. Barry also does not use a pivotal base plate to position either a sponge or abrasive cleaning strip in proper position for floor cleaning.

Various types of string mops and brooms have also been invented. Most of the brooms have only one side of the broom head with a brush or bristles. Those with two sided cleaning elements may have had a brush on one side and a rubber strip on the other side. None provided a pivotal head to position either cleaning element at a convenient angle for the user to stand upright, regardless of which element was contacting the floor.

OBJECTS AND ADVANTAGES OF THE INVENTION

It is an object of the present invention to provide an improved hand held cleaning device having a rigid base frame assembly which supports the cleaning head and cleaning elements during the cleaning operation. It is a related object to provide a mop having a sponge element mounted on one side of the frame assembly and a scrubbing element mounted on the other side. Another related object is to provide a cleaning device having one cleaning element mounted on one side of the frame assembly and a second cleaning element on the other side.

It is a related object to provide a cleaning device that presents either the first element or the second element to the surface to be cleaned by merely pivoting the cleaning head and turning the mop shaft 180°. It is a related object to provide a cleaning device which has a pivotal base frame assembly to allow the first cleaning element or the second cleaning element to be applied to the floor while maintaining the handle at a comfortable position for the user to perform the cleaning operation.

It is yet another object of the invention to provide a self-wringing mop that easily allows for the extraction of water from the sponge element without the user's hands contacting the sponge element. It is a related object to provide a self-wringing mop which provides for a slidable sleeve element which slides along the axis of the handle to activate the self-wringing mechanism.

It is yet another object of the invention to provide a self-wringing mop assembly that provides for a compression roller to roll over the sponge element to compress and wring absorbed fluids from the sponge.

Still another object is to provide a self-wringing mop assembly having a pivotal frame which pivots between two extreme positions, one position orienting the sponge element in proper relation to the floor and the second position orienting the scrubber to the floor. A related object is the object of providing a mop with an intermediary wringing position in which the base frame assembly is drawn past a roller which compresses the sponge element between the roller and the base frame assembly for extracting liquids from the sponge.

Still another object is the object of providing a self-wringing mop assembly having a sponge on one side of a base frame assembly and a scrubber element having approximately the same dimensions as the sponge on the other side of the base frame.

It is still another object to provide a self-wringing mop wherein the wringing mechanism does not strike or scratch the surface being mopped when the mop is in its cleaning position.

Another object is to provide a cleaning device having two brush-like cleaning elements, one on each side of the base frame which can be oriented to clean the floor by rotating the handle and pivoting the base frame assembly.

These and other objects and advantages will be apparent upon reading the brief description of the drawings and the description of the preferred embodiment.

SUMMARY OF THE INVENTION

The present invention is a hand held cleaning device for cleaning floors and other flat surfaces. In one embodiment, there is an elongated handle having a longitudinal axis with a base frame assembly attached to the bottom end of the handle. The base frame assembly is a substantially rigid planar surface which has a sponge element on one of the surfaces and a scrubbing element on the opposite surface. The base frame is pivotally connected to the bottom end of the elongated handle such that the base frame can pivot between two cleaning positions. In the first position, the sponge is substantially parallel with the floor and the handle extends at an acute angle to the floor for ease by the operator in mopping. In the other position, the base frame is pivoted to the second position and the handle is rotated 180° about its axis such that the scrubbing element is parallel with the floor and the handle is maintained at a comfortable working angle with respect to the floor surface. There is a sleeve mounted toward the lower half of the elongated handle with a roller mechanism mounted at the bottom of the sleeve. When the sponge element is saturated, the user slides the sleeve toward the bottom of the elongated handle. The base frame assembly pivots to an intermediary position between the two cleaning positions, and the sponge element is drawn past the roller mechanism, wringing absorbed fluids from the sponge element. After the liquid is wrung from the sponge, the sleeve is drawn back into its initial position and the base frame assembly is pivoted by the user into a position with the sponge or scrubbing element oriented parallel to the cleaning surface and the handle resuming a convenient angle with respect to the floor for ease in operation.

In another embodiment, there is a frame assembly attached by pivot means to the bottom of the handle. The frame has two cleaning elements, one mounted on either side of the frame. The cleaning elements can be brushes, scrubber pads or sponges. The frame can be pivoted to either of two positions to orient either of the cleaning elements into a parallel relationship with the floor. A toe piece protruding from the leading edge of the frame assists in pivoting the frame from one cleaning position to the other.

DESCRIPTION OF THE PREFERRED EMBODIMENT

Figure 1:
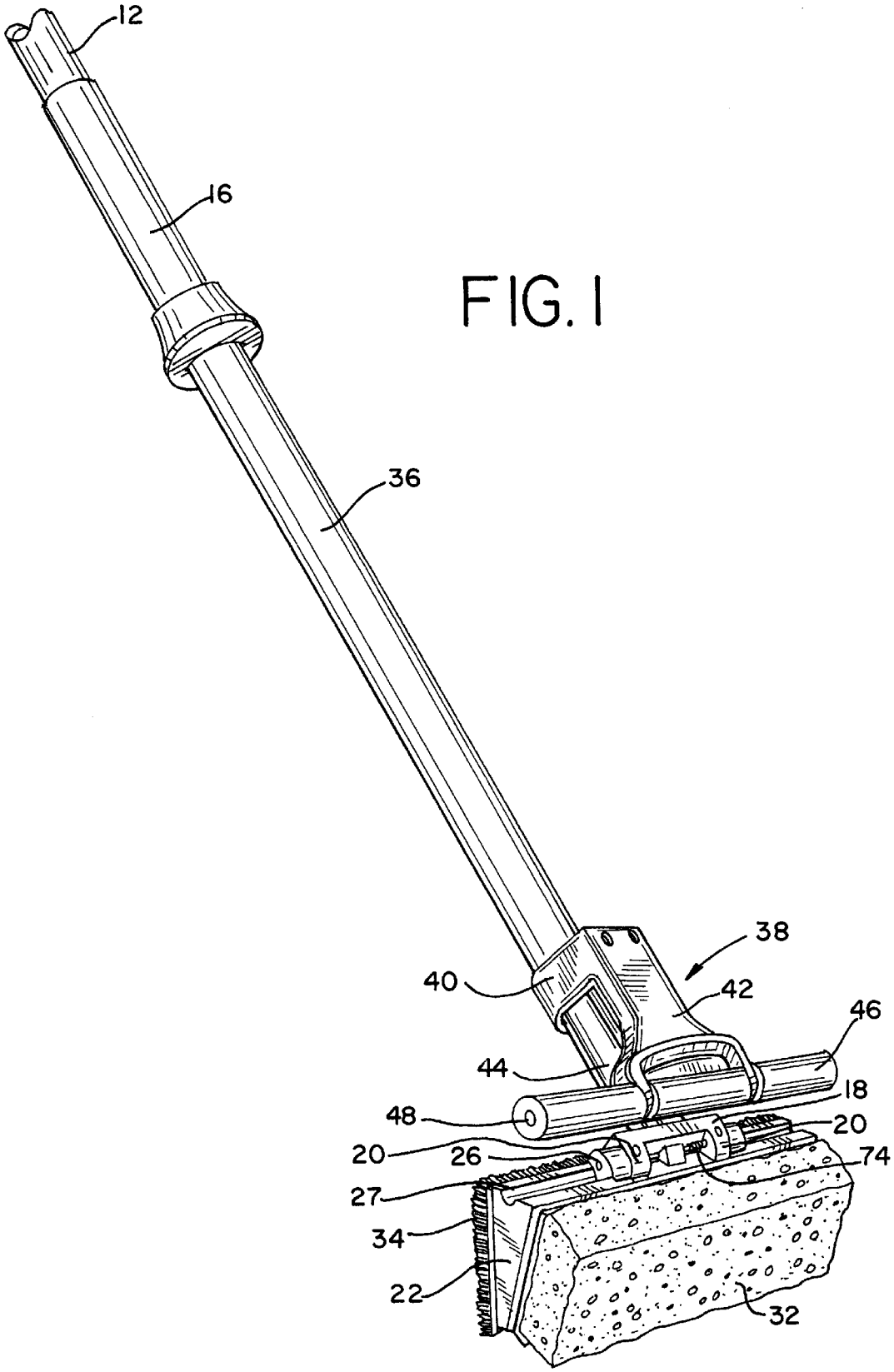
FIG. 1 is a perspective view, with portions removed, of the inventive mop assembly showing the bottom of the sponge and back of the roller assembly used to wring liquid from the sponge.
Figure 2:
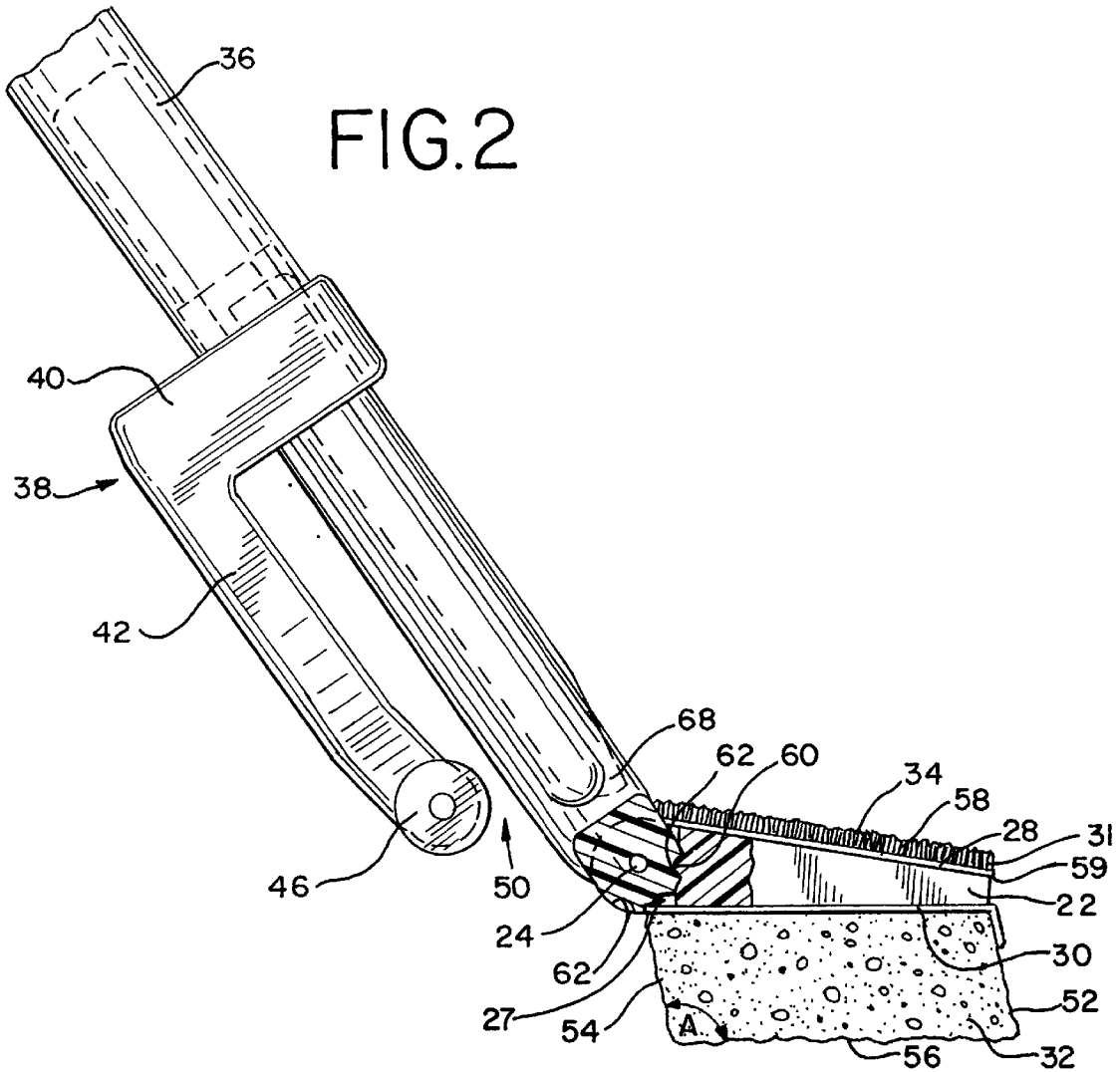
FIG. 2 is a side elevation view with portions removed and partially in cross-section showing the manually operable wringing assembly with the mop in its first cleaning position with the sponge oriented to absorb fluid from a flat surface.

Turning first to FIG. 1, a self-wringing mop 10 of the present invention is illustrated. There is an elongated handle 12 having a top end (not shown) and a bottom end 14. The elongated handle 12 has a longitudinal axis extending along the entire length of the handle 12. The overall length of the handle 12 is approximately 4 to 5 feet in length. Attached to the bottom end 14 is a U-shaped bracket 18, which has two upstanding legs 20. A base frame assembly 22 is pivotally connected to the bottom end 14 by means of a pivot pin 24 passing through the two legs 20 and bushings 26 formed on an inner edge 27 of the base frame 22. When pivotally connected to the base frame 22, the legs 20 extend into respective grooves 29 formed in the edge 27 of the base frame between the bushings 26 wherein the legs 20 can pivot in the grooves 29. As seen in FIGS. 1 and 2, the base frame 22 is wedge shaped with the greater height of the wedge at the inner edge 27 being disposed adjacent to the bottom end 14 with the height tapering to an outer edge 31. The base frame 22 also has top and bottom planar surfaces 28, 30 that are slightly non-parallel due to the wedge shape of the base frame 22.

As seen in FIG. 2, the base frame 22 is oriented at a ergonomic angle to the longitudinal axis of the handle 12 so that it is comfortable for an upstanding user to use the mop with either the surface 28 or surface 30 of the base frame 22 being substantially parallel with the floor surface to be mopped.

There is a sponge member or element 32 mounted to the bottom planar surface 30 and two sections of a scrubber pad 34 are mounted to respective sections of the top planar surface 28. The sponge element 32 may be first affixed to an intermediary plate which is releasably attached to the bottom planar surface 30 and the scrubber pad 34 may similarly be mounted to an intermediary plate to be releasably attached to the top planar surface 28. In another embodiment, the sponge and scrubber pad may be made in a single continuous circular piece which is slid over the base frame 22 and can be slid off for easy replacement. Although the base frame 22 is shown pivotally connected to the bottom end 14 by means of a pivot pin 24, other pivot or hinge arrangements could likewise be used with satisfactory results. The particular type of hinge or pivot connection is not critical, only that the connection allows the base frame 22 to rotate with respect to the bottom end 14 between pre-determined positions.

Surrounding approximately the lower half of the elongated handle 12 is an actuator 36 for a wringing assembly. The actuator 36 is movable along the longitudinal axis of the handle and includes at one end a roller 46 on one side of the handle 12 and spaced therefrom and a force opposing member 68 on the opposite side of the handle. The actuator 36 may be formed as a a slidable sleeve 36. The top portion of the sleeve 36 includes a grasping portion 16 that may include a foam cover or the like for easy gripping. The actuating sleeve 36 surrounds the lower half of the handle 12 and is allowed to freely slide laterally along the handle 12 between pre-determined fixed points. At the bottom of the actuating sleeve 36 is a bracket 38 which is mounted to the actuating sleeve by means of a collar 40. The bracket 38 is further comprised of an arm 42 which extends parallel to the long axis of the handle 12. As can be seen in FIG. 2, the arm 42 is displaced from the handle 12 but substantially parallel thereto. The arm 42 terminates in a yoke 44 which is adjacent to but displaced from the bottom end 14 of the handle 12. The roller 46 is segmented into three compression rollers 46', 46", and 46'" that are mounted on a shaft 48 which extends through the yoke 44. Although three rollers 46 are illustrated, the specific number of rollers is not critical, only that a roller surface be available to compress the sponge 32 as will be more fully disclosed later. As can be seen in FIG. 2, a gap 50 is formed between the circumference of the roller 46 and the outer wall of the elongated handle 12.

Figure 2A:
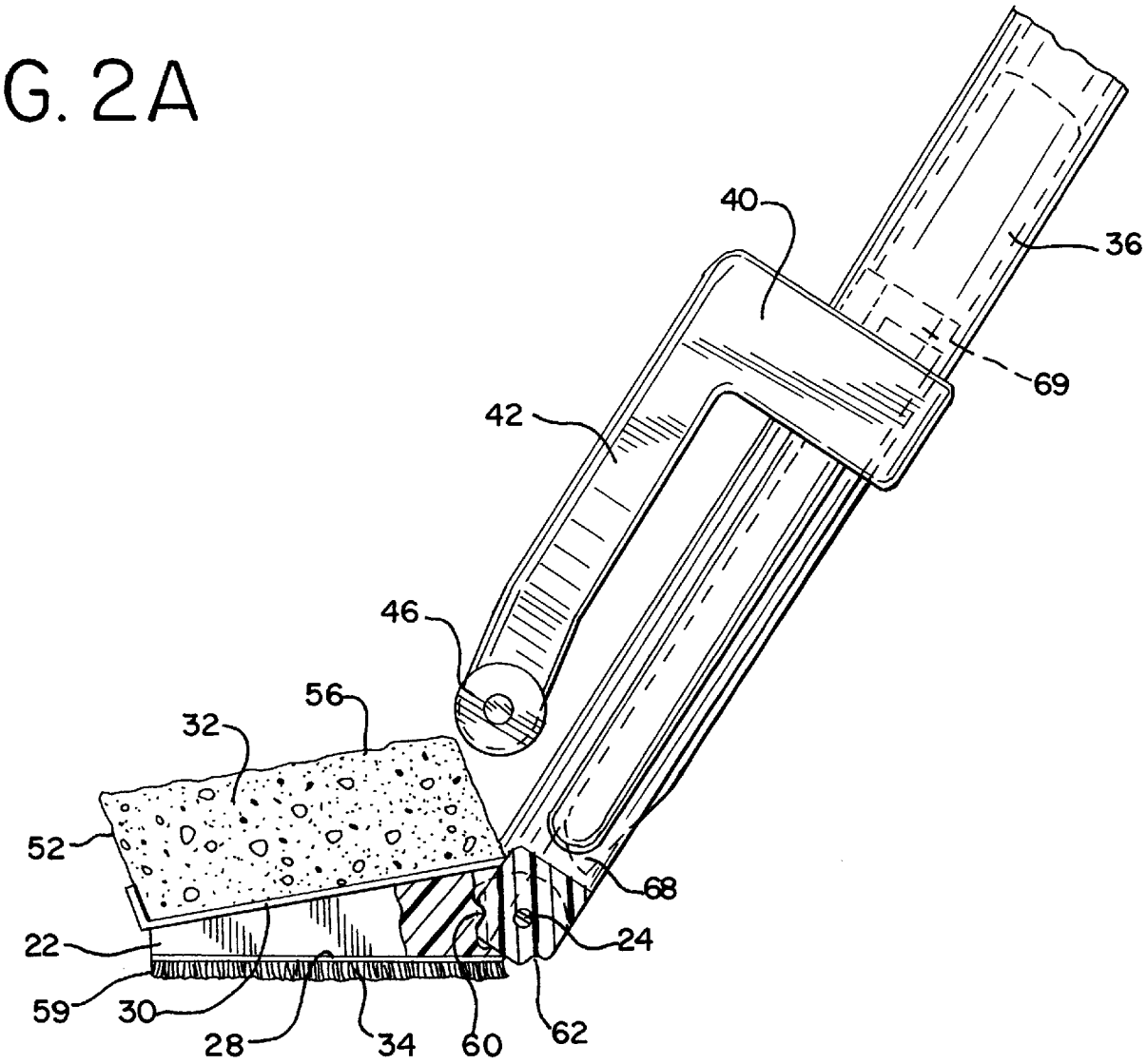
FIG. 2A is a side elevation view with portions removed and partially in cross section showing the mop in its second cleaning position with the scrubber pad oriented to scrub a float surface.

As seen in FIG. 2, the sponge 32 is somewhat trapezoidal in its configuration. There is a leading or outer edge 52 which extends forward of the front edge of the base frame 22. In this way, the sponge will contact a wall or upstanding article of furniture before the base frame 22 strikes it. The sponge 32 has a trailing edge 54 which forms an obtuse angle with respect to the long axis of the handle 12. The trailing edge of the sponge 54 results in the sponge forming an obtuse angle "A". The bottom of the sponge 56 is substantially flat to contact the normally flat surface which will be mopped. The scrubber pad 34 also has a substantially flat surface 58 which, when in its operable scrubbing position as shown in FIG. 2A, will engage the normally flat surface which it will be scrubbing.

Figure 6:
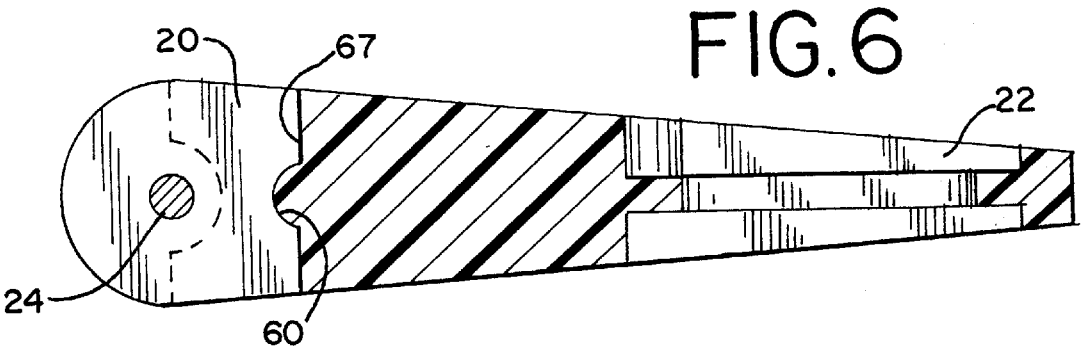
FIG. 6 is a cross-sectional view taken along line 6—6 of FIG. 5 showing the detent on the base frame used to retain the base frame in one of its cleaning positions.
Figure 7:
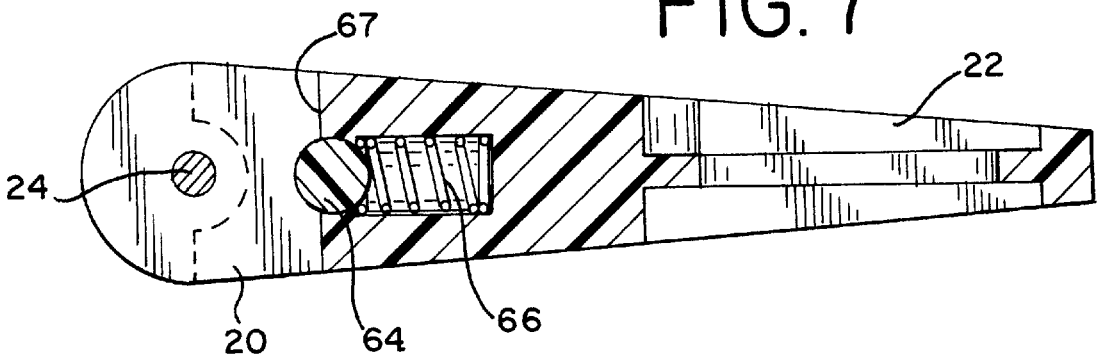
FIG. 7 is an alternate embodiment of the detent assembly of FIG. 6 in which a ball and spring are utilized to retain the base frame in one of its cleaning positions.

The base frame 22, as shown in FIG. 2, is oriented such that the sponge 32 is in its operable mopping position with the sponge 32 contacting the floor. If it is desired to have the scrubber pad 34 contacting the floor, the handle 12 is rotated 180° about its longitudinal axis so that an outer edge 52 of the sponge member 32 and/or an outer edge 59 of the scrubber pad 34 contacts the surface to be cleaned with the scrubber pad 34 facing the user. A force is applied to the handle that is generally downward and/or towards the user. This causes the base frame to pivot into the position shown in FIG. 2A. The base frame 22 rotates about the pivot pin 24 through an approximately 70° angle between the frame's first position, as shown in FIG. 2, with the sponge contacting the surface to be cleaned, and the frame's second position, as shown in FIG. 2A, with the scrubbing member in contact with the surface to be cleaned. The base frame 22 is thus pivoted between the first and second positions to change the cleaning member, i.e. sponge or scrubber pad, that is to contact the floor without the user touching the base frame or cleaning member. As seen in FIG. 6, there is a protrusion 60 on the base frame 22 which engages a detent or notch 62 in the U-bracket 18. The protrusion may be integrally formed with the frame 22. As seen in FIG. 7, in an alternate method of retaining the base frame 22 in the detent or notch 62, the protrusion 60 is formed as a ball 64 that is urged into the detent or notch 62 by means of a spring 66 mounted in a cavity of the base frame 22. A protrusion may be formed in the base 67 of each of the grooves 27 formed in the inner edge of the base frame 22. Further, at least two notches, one associated with the sponge cleaning position, as shown in FIG. 2, and one associated with the scrubber cleaning position, as shown in FIG. 2A, may be formed on the outer surface of each of the legs 20.

Thus, as illustrated, the base frame 22 is positioned in either of two extreme orientations. The first is illustrated in FIG. 2 with the sponge contacting the floor, and the second with the base frame pivoted to its second extreme position and the scrubber pad 34 contacting the floor. The protrusion 60 engaging the detent 62 retains the base frame 22 in a proper cleaning position depending upon which cleaning element is desired.

Figure 5:
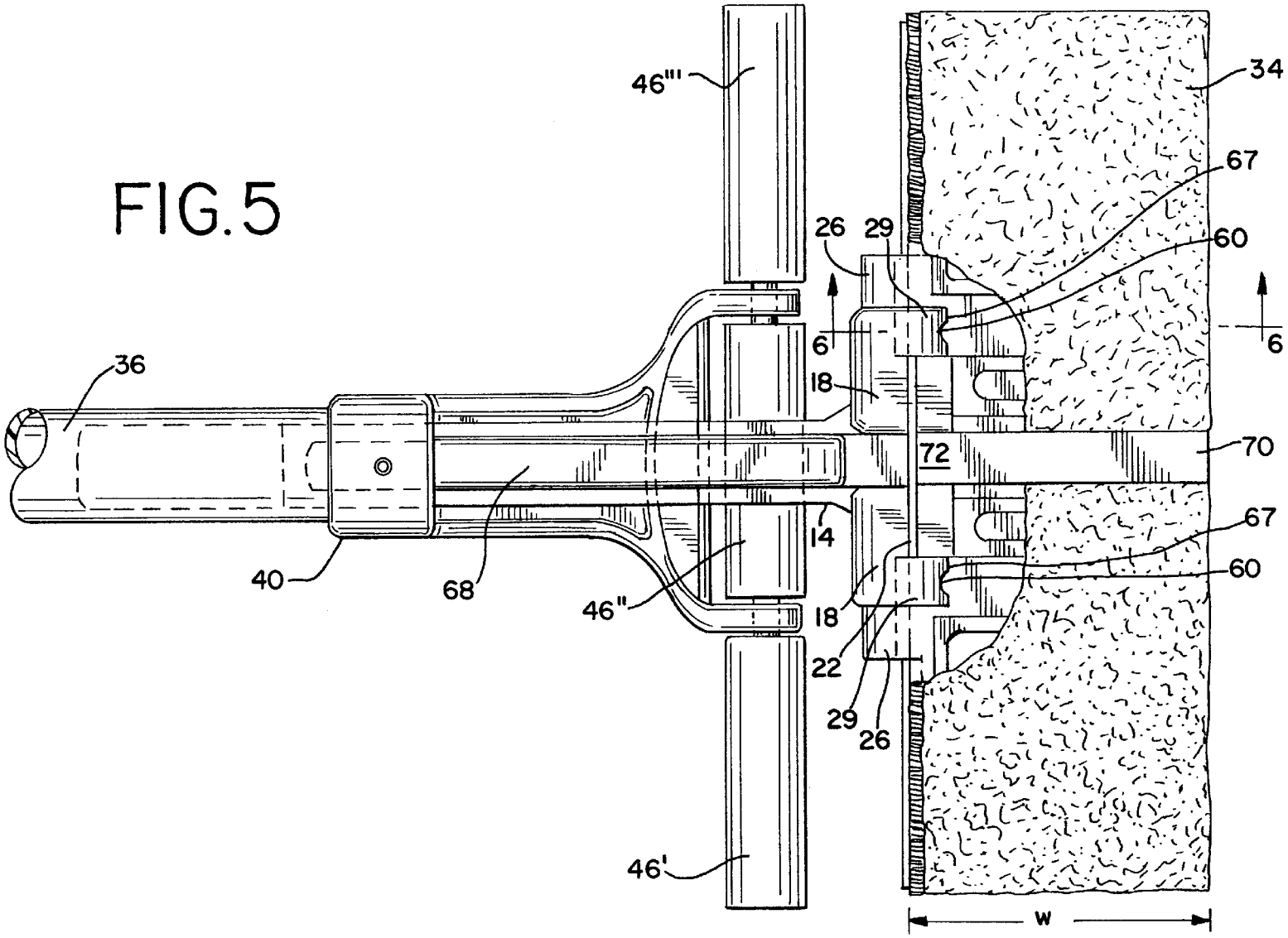
FIG. 5 is a top plan view with portions removed of the mop of FIG. 2 showing the scrubber pad and mechanism used to pivot the base plate into the wringing position shown in FIG. 4.

As can be seen in FIGS. 2 and 5, the force opposing member 68 is elongated, forming a tongue extending from the sleeve of the actuator 36 in a channel 69 formed in the handle 12. The operable length of the tongue is approximately the same as a width "W" of the scrubber pad 34. Also as seen in FIG. 5, the base frame 22 has a groove 70 extending centrally across the width of the scrubber pad 34. The width of the groove is slightly greater than the width of the tongue 68. The groove 70 is adapted to receive the tongue 68 in sliding engagement during the wringing of the sponge.

Figure 3:
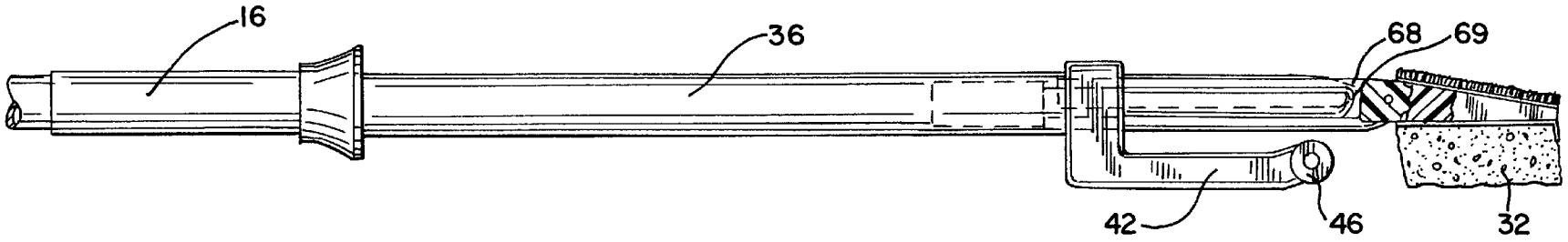
FIG. 3 is a side elevation view of the mop assembly with the sleeve assembly retracted and the base plate in a central position between the two cleaning positions.
Figure 4:
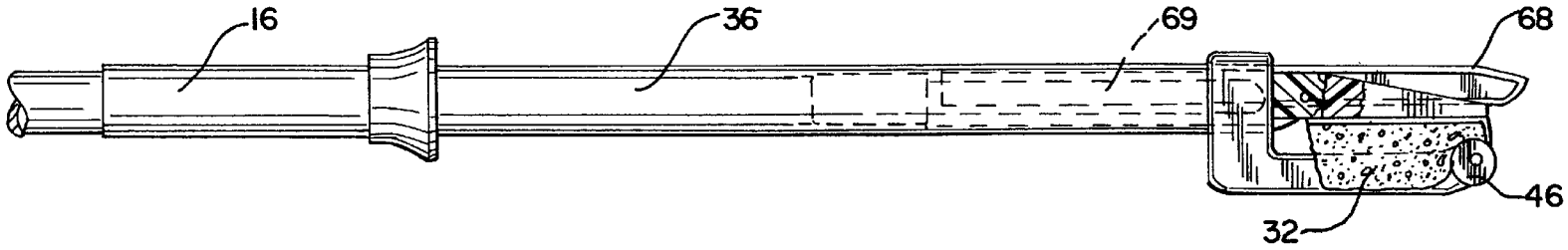
FIG. 4 is a side elevational view similar to FIG. 3 except with the sleeve assembly pushed all the way to its lowest position on the elongated handle with the wringing assembly in its completed wringing position.

During mopping, the sponge 32 becomes saturated with water. The user lifts the mop 10 from the wet surface and positions the sponge 32 over a bucket or other suitable disposal means to dispose of the absorbed fluid. The grasping portion 16 is pushed toward the bottom end 14 to move the actuator 36 laterally along the elongated handle 12. The force opposing member 68 slides forward and engages a rear entrance 72 to the groove 70. The tongue 68 forces the base frame 22 to pivot the mopping position illustrated in FIG. 2 to an intermediate position illustrated in FIGS. 3 and 4. In this position, an axis of the base frame extending along the width "W" thereof is substantially parallel with the longitudinal axis of the handle 12. The rollers 46 engage the trailing edge 54 of the sponge 32 and compress the sponge between the roller 46 and the base frame 22. This is assisted by the angle A formed between the trailing edge 54 with respect to the bottom edge 56. The distance separating the circumference of the rollers 46 and the base frame 22 is approximately the same as the gap 50. The grasping portion 16 and sleeve 36 continue their lateral movement toward the bottom end 14 until the bracket 18 strikes the collar 40. At this point, the rollers 46 reach the leading edge 52 of the sponge 32 as seen in FIG. 4. In this manner, the sponge 32 is progressively wrung and entrapped liquid is removed as the rollers move from the trailing edge 54 to the leading edge 52. The grasping portion 16 and sleeve 36 are then drawn back along the elongated handle 12 to their initial position. As the actuating sleeve 36 is withdrawn, the roller 46 compresses the sponge on its return and, in essence, squeezes the sponge on its reverse stroke, removing additional liquid. A detent may be formed on the legs 20 in association with the intermediate position to hold the base frame 22 in that position. However, this extra detent is not necessary.

If desired, a spring 74 (FIG. 1) may be disposed around the pivot pin 24 and engages the U-shaped bracket 18, causing the base frame 22 to rotate back into the position illustrated in FIG. 2. The base frame 22 is oriented with the sponge 32 ready to mop. In another embodiment, the spring 74 is not used and the base frame is free to pivot to the mopping position, the scrubbing position, or an intermediary position for squeezing liquid out of the sponge. When no spring is used, the user merely pivots the by exerting force on the handle 12 so that the desired sponge or scrubber pad is presented to the floor. The detent 60 or ball 64 seats in the notch 62 to releaseably hold the base frame in the chosen position. When the other position is desired, the user applies a pivotal force to the base frame 22 causing it to rotate to the other position.

Figure 8:
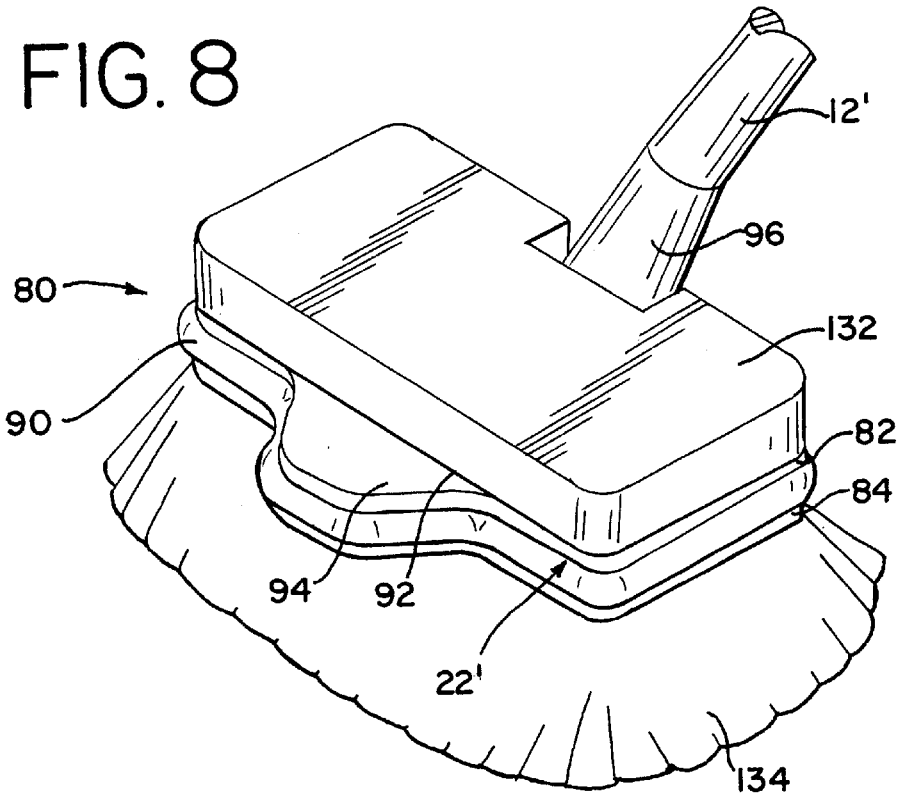
FIG. 8 is a perspective view with portions removed of an alternate embodiment.

Another hand held cleaning device is illustrated in FIG. 8. This alternate embodiment is similar to the first embodiment in that it utilizes the unique pivoting head assembly. As seen in FIG. 8, there is a cleaning device 80 with a handle 12' having a longitudinal axis similar to the first embodiment. There is a base frame assembly 22' comprised of an upper base plate 82 and a lower base plate 84. The base plates 82 and 84 are identical and have substantially flat upper and lower surfaces 86 and 88. The upper surface 86 of the lower base plate 84 is fastened to the lower surface 88 of the upper base plate 82. A flexible bumper 90, preferably made of a soft flexible rubber tubing, extends around and protrudes out from the base frame 22. The bumper 90 has a flange 91 which is held between the fastened upper and lower base plates 82, 84 retain the bumper 90 in place. Extending forward from a leading edge 92 of the base frame assembly 22' is a toe 94. The tow 94 assists in pivoting the base frame 22' between its two cleaning positions as will be described more fully later.

Figure 10:
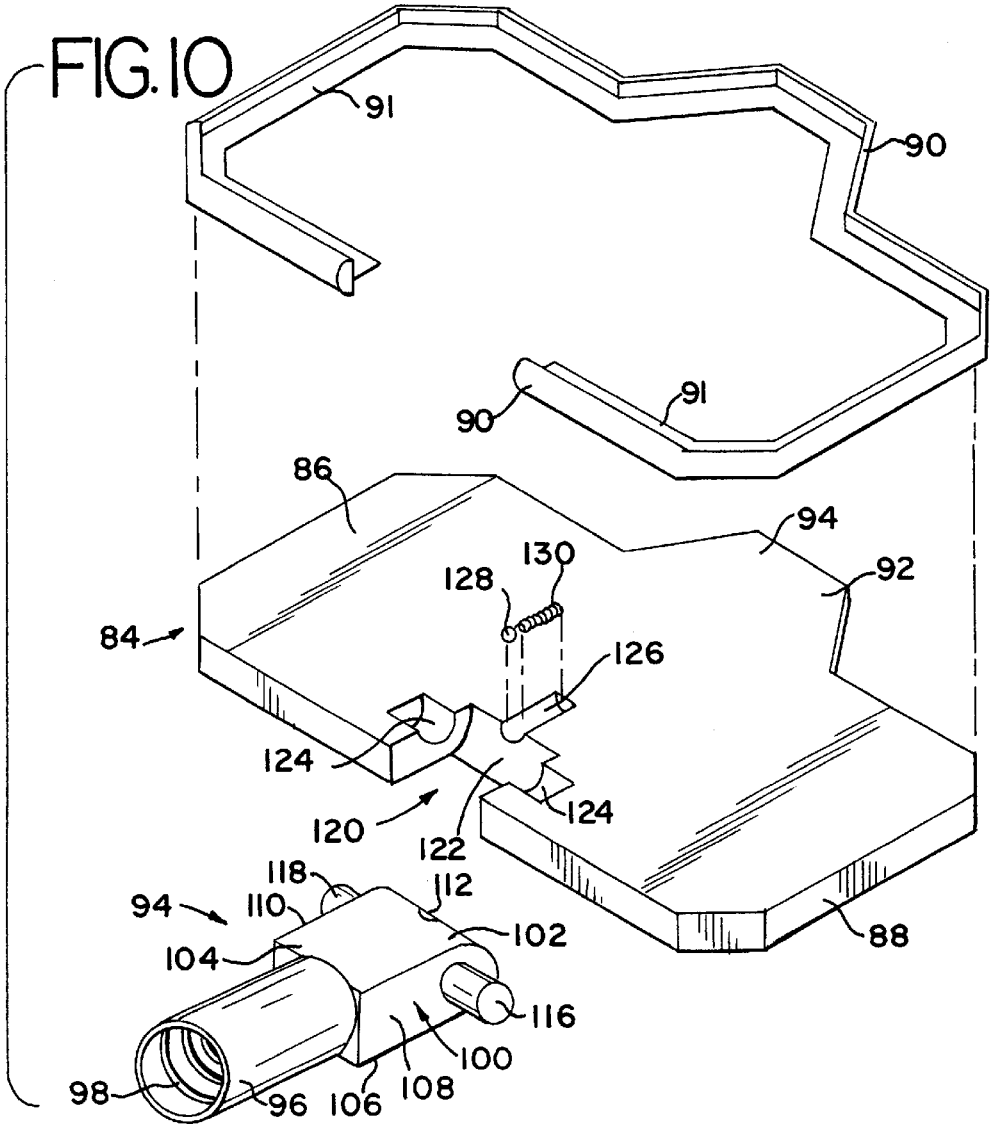
FIG. 10 is an exploded view of the frame assembly of the alternate embodiment.
Figure 11:
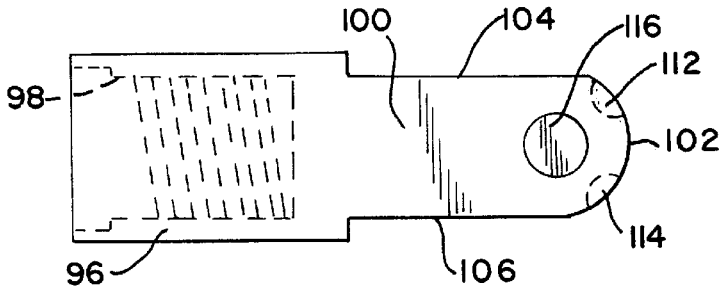
FIG. 11 is a side view of the pivoting member which connects the handle to the base frame in the alternate embodiment.
Figure 12:
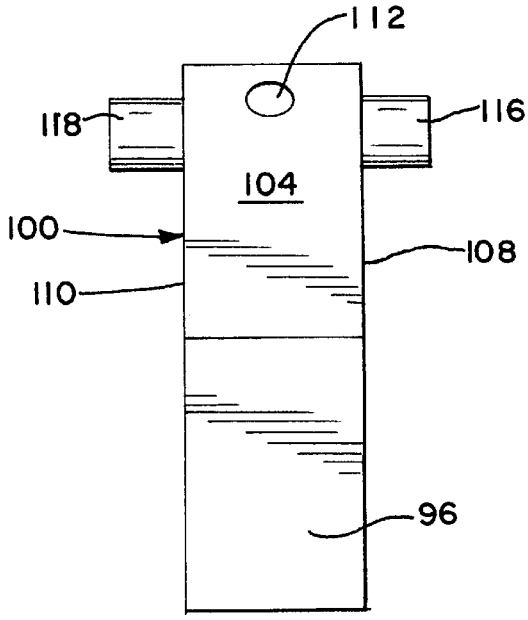
FIG. 12 is a top view of the pivoting member shown in FIG. 11.

As seen in FIG. 10, there is a pivoting member 94 which connects the handle 12' to the base frame 22'. The pivoting member 94 has a tubular portion 96 having internal threads 98. Handle 12' has a bottom end 14' which is also threaded to be received within the tubular portion 96. Pivoting member 94 has a block portion 100 which terminates in a curved front surface 102 at an opposite end from the tubular portion 96.

The block portion 100 has a top surface 104, a bottom surface 106 and opposite sides 108 and 110. There are a pair of detents or notches 112, 114 at the juncture of the top or bottom surface 104, 106 and the curved front surface 102. Extending outward from the sides 108, 110 are a pair of pivot pins or dowels 116, 118 respectively.

Figure 9:
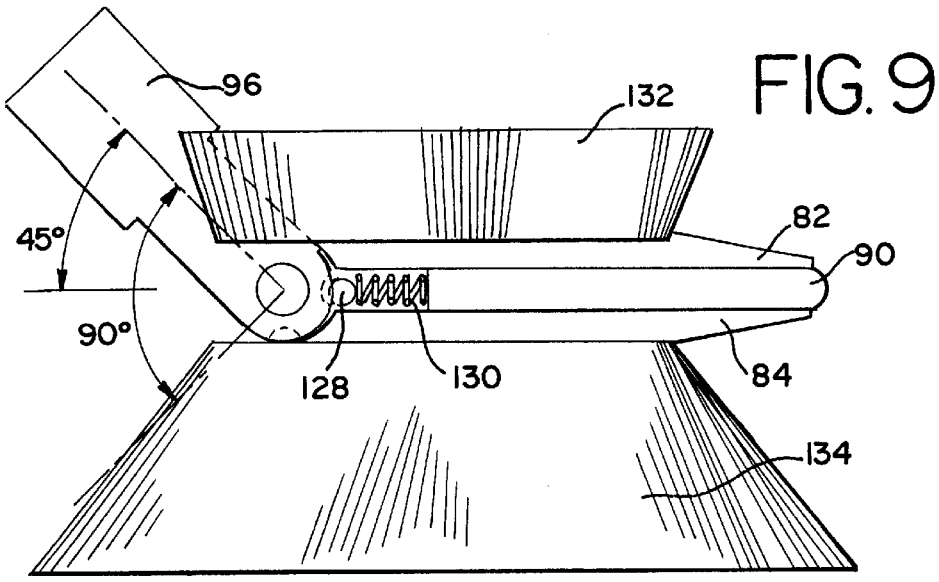
FIG. 9 is a side view, partially in cross section of the device shown in FIG. 8.

The upper and lower base plates 82, 84 have a recessed portion 120 cut in one side opposite the toe 94. The width of the recessed portion 120 is slightly greater than the width of the block 100. The recessed portion terminates at a curved surface 122 which has a curvature substantially the same as the curved front surface 102. A pair of semi-circular slots 124 extend in opposite directions from the recessed portion 120 into the lower surface 88. The slots 124 receive pivot pins 116, 118. There is a groove 126 cut into the top surface 88 extending from the curved surface 122. The groove 126 receives a ball 128 and spring 130. The upper base plate 82 and lower base plate 84 are mirror images of each other so that an identical recessed portion 120, slots 124 and groove 126 are similarly positioned in a face to face relationship when the upper and lower base plates 82, 84 are fastened to each other as illustrated in FIG. 9.

When assembling the base plates 82, 84, the pivoting member 94 is positioned with the pins 116, 118 in the slots 124. The spring 130 and ball 128 are placed in groove 126. The bumper 90 is positioned with the flange 91 lying on the upper surface 86. The upper base plate 82 is positioned over the lower base plate 84 and the recessed portions 120 and slots 124 are aligned. The pivot pins 110 and 116 are captured in the slots 124 with the slots defining a tubular passageway in which the pins 16, 118 can rotate. The spring 130 urges the ball 128 into either of the detents 112, 114.

Figure 13:
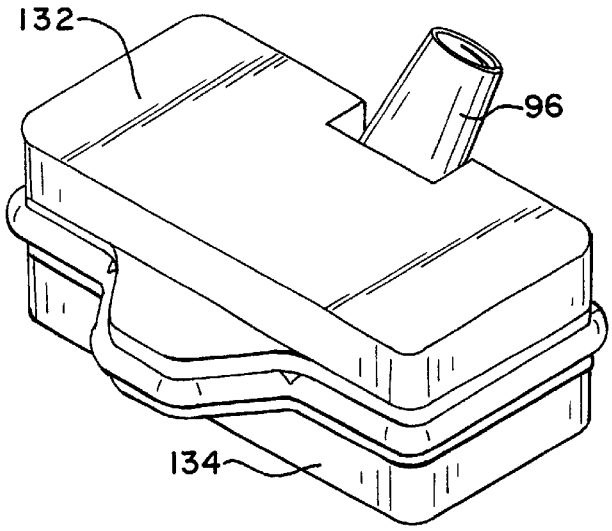
FIG. 13 is a second alternate embodiment of a cleaning element head having two scrubber elements.

As seen in FIG. 8, attached to the upper surface of the upper base plate 82 is a first cleaning element 132 depicted as a scrubber pad. Attached to the lower surface 88 of the lower base plate 84 is a second cleaning element 134 depicted as a brush. As seen in FIG. 9, the first and second cleaning elements are both shown as brushes. The brushes can be of differing material and stiffness for varying cleaning operations. As seen in FIG. 13, the two cleaning elements 132, 134 are illustrated as scrubber pads, which again may be of different texture and material for differing cleaning functions.

The base frame 22' can be positioned in either of two cleaning positions. The first is illustrated most clearly in FIG. 9 with the second cleaning element 134, which is shown as a brush, oriented downward to contact the floor or surface to be cleaned. The second position, although not illustrated, will be similar to FIG. 9 except the base frame 22' is pivoted 90° and the first cleaning element 132 is oriented downward to contact the floor or surface to be cleaned. The ball 128 engages the detent 112 or 114 to retain the base frame 22' in the proper cleaning position depending upon which cleaning element is desired.

As seen in FIG. 9, the second cleaning element 134 is in its operable cleaning position. If it is desired to have the first cleaning element 132 contact the floor, the handle 12' is rotated 180° about its longitudinal axis so that the rubber bumper 90 surrounding the toe 94 contacts the surface to be cleaned. When the handle 12' is rotated approximately 180°, base frame 22' is standing relatively upright on the toe 94. A force is applied to the handle 12' that is generally downward and/or toward the user causing the base frame 22' to pivot through an approximately 90° angle about the pivot pins 116, 118 and orient the first cleaning element 132 into its operable cleaning position. The ball 128 is released from detent 112 and re-engages detent 114. The top surface 104 or bottom surface 106 of the block 100 engages the upper or lower base plate 82, 84 and acts as a stop to keep the handle 12' from pivoting too far.

The toe 94 and bumper 90 frictionally engage the floor or surface to be cleaned to assist in pivoting the base frame 22' from one cleaning position to the other. The bumper provides the dual purpose of providing the frictional force and also protects any surface that the base frame 22' contacts. The overall operation of orienting either the first or second cleaning elements is similar to the first embodiment of the sponge mop, except the bumper 90 and toe 94 are additional members to assist in pivoting operation. The toe 94 and bumper 90 could likewise be added to the first embodiment, although it is not essential for the device illustrated in the first embodiment to have these elements in order to operate properly.

While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the sprit and scope of the appended Claims.

What is claimed is:

1. A hand held cleaning device for cleaning a surface comprising:

a first cleaning element;

a second cleaning element;

a frame having a first side for supporting the first cleaning element and a second side generally opposite to the first side for supporting the second cleaning element;

a handle having a bracket mounted at an end for pivotally connecting the handle to the frame to allow the frame to be pivoted from a first position, with the first cleaning element in contact with the surface to be cleaned, to a second position, with the second cleaning element in contact with the surface to be cleaned, by rotating the handle and exerting a force on the handle to cause the frame to pivot from the first position to the second position without the need for the user to touch the frame or cleaning elements, the bracket having a plurality of detents, the detents being associated with the first and second positions and at least one protrusion that extends from an edge of the frame and mates with one detent in the first position and mates with another detent in the second position, the protrusion exerting a holding force within the detent to hold the frame in the first position or in the second position with respect to the handle until the force on the handle overcomes the holding force of the protrusion, thus allowing the frame to pivot.

2. A hand held cleaning device for cleaning a surface as recited in claim 1 wherein the handle is at a non-right angle with respect to the first frame side when the frame is in the first position and wherein the handle is at a non-right angle with respect to the second frame side when the frame is in the second position.

3. A hand held cleaning device for cleaning a surface as recited in claim 1 wherein the frame has a generally wedge shaped cross section so that the first and second generally opposite sides of the frame are non-parallel.

4. A hand held cleaning device for cleaning a surface as recited in claim 1 wherein the frame has a generally rectangular cross section so that the first and second generally opposite sides of the frame are parallel.

5. A hand held cleaning device for cleaning a surface as recited in claim 1 wherein the frame is pivoted from the first position to the second position by rotating the handle generally about a longitudinal axis of the handle to position an outer edge of the cleaning elements in contact with the surface to be cleaned and thereafter exerting a generally downward force on the handle.

6. A hand held cleaning device for cleaning a surface as recited in claim 1 wherein the protrusion is integrally formed with the frame.

7. A hand held cleaning device for cleaning a surface as recited in claim 1 wherein the protrusion is a ball urged toward the detent by a spring mounted in a cavity of the frame.

8. A hand held cleaning device for cleaning a surface as recited in claim 1 wherein the first cleaning element is a sponge member and the second cleaning element is a scrubbing member.

9. A hand held cleaning device for cleaning a surface as recited in claim 8 including a wringer assembly comprising an actuator manually movable along a longitudinal axis of the handle and having at one end an elongated member and a roller spaced therefrom, the elongated member being positioned on one side of the handle and the roller being positioned on an opposite side of the handle, the elongated member and roller being movable with the actuator from a non-wringing position to a wringing position with the roller in contact with the sponge member and the elongated member in contact with the second side of the frame, the movement of the actuator into the wringing position pivoting the frame from either the first position or the second position into an intermediate position with an axis of the frame generally parallel to the longitudinal axis of the handle.

10. A hand held cleaning device for cleaning a surface as recited in claim 9 wherein the elongated member has a length that extends generally parallel to the longitudinal axis of the handle.

11. A hand held cleaning device for cleaning a surface as recited in claim 10 wherein the second side of the frame includes a groove into which the elongated member slides when the actuator is moved from the non-wringing position to the wringing position.

12. A hand held cleaning device for cleaning a surface as recited in claim 9 wherein the roller has a length extending generally perpendicular to the longitudinal axis of the handle.

13. A hand held cleaning device for cleaning a surface as recited in claim 12 wherein the roller has a plurality of roller segments extending along the length thereof.

14. A hand held cleaning device for cleaning a surface as recited in claim 9 wherein the actuator is formed as a sleeve about the handle and having at one end the roller and elongated member and having at an opposite end a gripping portion to be gripped by the user to move the actuator along the longitudinal axis of the handle.

15. A hand held cleaning device for cleaning a surface as recited in claim 9 wherein the sponge member has an outer edge and an inner edge adjacent to the handle, the inner edge being at an obtuse angle with respect to the handle when the frame is in the intermediate position.

16. A hand held cleaning device for cleaning a surface as recited in claim 9 wherein the sponge and the scrubbing member are releasably mounted on the frame to allow replacement.

17. A hand held cleaning device for cleaning a surface as recited in claim 1 wherein the first cleaning element is a brush member and the second cleaning element is a scrubbing member.

18. A hand held cleaning device for cleaning a surface as recited in claim 1 wherein the first and second cleaning elements are brush members.

19. A hand held cleaning device for cleaning a surface as recited in claim 1 wherein the first and second cleaning elements are scrubber members.

20. A hand held cleaning device for cleaning a surface as recited in claim 1 and further comprising a forwardly extending member on the frame, the forwardly extending member extending from the frame in a direction opposite the handle and pivotally connected to the frame, the forwardly extending member contacting the surface to be cleaned when the handle is rotated to pivot the frame from the first position to the second position.

21. A hand held cleaning device for cleaning a surface as recited in claim 20 and further comprising a protective flexible guard member around the perimeter of the forwardly extending member.

22. A mop for cleaning a surface comprising:

a sponge member;

a scrubbing member;

a frame having a first side for supporting the sponge member and a second side generally opposite to the first side for supporting the scrubbing member;

a handle having an end pivotally connected to the frame to allow the frame to be pivoted from a first position with the sponge member in contact with the surface to be cleaned to a second position with the scrubbing member in contact with the surface; and a wringing assembly with an actuator movable along a longitudinal axis of the handle, the actuator having at one end a roller and a force opposing member spaced from the roller with the handle therebetween, the roller and force opposing member being movable with the actuator from a non-wringing position to a wringing position with the roller in contact with the sponge member and the force opposing member engaging the second side of the frame to oppose the force of the roller, the movement of the actuator into the wringing position pivoting the frame from the first position to a position intermediate to the first and second positions with an axis of the frame generally parallel to the longitudinal axis of the handle.

23. A mop for cleaning a surface as recited in claim 22 wherein the force opposing member is an elongated member having a length that extends generally parallel to the handle.

24. A mop for cleaning a surface as recited in claim 23 wherein the second side of the frame includes a groove into which the elongated member slides when the actuator is moved from the non-wringing position to the wringing position.

25. A mop for cleaning a surface as recited in claim 23 wherein the handle includes a channel in which the elongated member moves as the actuator is moved.

26. A mop for cleaning a surface as recited in claim 22 wherein the roller has a length extending generally perpendicular to the handle.

27. A mop for cleaning or scrubbing a surface as recited in claim 26 wherein the roller has a plurality of roller segments extending along the length thereof.

28. A mop for cleaning or scrubbing a surface as recited in claim 22 wherein the actuator is formed as a sleeve about the handle and having at one end the roller and force opposing member and having at an opposite end a gripping portion to be gripped by the user to move the actuator along the longitudinal axis of the handle.

29. A mop for cleaning and scrubbing a surface as recited in claim 22 wherein the frame is pivotal between the first and second positions with the actuator in the non-wringing position without the need for the user to touch the frame with sponge and scrubbing members.

30. A mop for cleaning and scrubbing a surface as recited in claim 22 wherein the frame is pivotable between the first and second positions by rotating the handle about its longitudinal axis to position an outer edge of the sponge and/or scrubbing member in contact with the surface to be cleaned and exerting a generally downward force on the handle.

31. A mop for cleaning or scrubbing a surface as recited in claim 22 wherein the frame and handle have mating surfaces that hold the frame in the first or the second positions with respect to the handle until a force on the handle overcomes the holding force of the mating surfaces allowing the frame to pivot.

32. A mop for cleaning or scrubbing a surface as recited in claim 31 wherein said mating surfaces include a detent associated with each of said first and second positions and a protrusion that mates with either of the detents.

33. A mop for cleaning or scrubbing a surface as recited in claim 22 wherein the frame has a generally wedge shaped cross section so that the first and second generally opposed sides of the frame are non-parallel.

34. A mop for cleaning or scrubbing a surface comprising:

a sponge member and a scrubbing member;

a frame having a first side for supporting the sponge member, a second side generally opposite to the first side for supporting the scrubbing member and a groove in the second side;

a handle having an end pivotally connected to the frame to allow the frame to be pivoted from a first position, with the sponge member in contact with the surface to be cleaned, to a second position, with the scrubbing member in contact with the surface to be cleaned, the frame and handle end having mating surfaces that hold the frame in the first or second positions until a force overcomes the holding force to allow the frame to pivot; and a wringing apparatus movable along the longitudinal axis of the handle with a roller on one side of the handle and a force opposing member on the opposite side of the handle wherein the roller is moveable into contact with the sponge member and the force opposing member is moveable in the groove of the frame to pivot the frame to a position intermediate to the first and second positions to wring the sponge.

35. A self-wringing mop for cleaning a surface comprising:

an elongated handle having a longitudinal axis and opposite top and bottom ends, a base frame assembly having a first side and a second side generally opposite the first side, a sponge element mounted on the first side of the base frame and a scrubbing element mounted on the second side, pivotal connection means for securing the base frame to the bottom end of the elongated handle, the base frame assembly disposed at a first cleaning angle to the longitudinal axis of the handle for presenting the sponge element to the surface to be cleaned, and the pivotal connection means allowing the base frame assembly to be pivoted to a second cleaning angle to the longitudinal axis for presenting the scrubbing element to the surface to be cleaned, a slidable sleeve mounted on the elongated handle for limited lateral movement along the handle, means on the sleeve to engage the base frame assembly for pivoting the base frame assembly from either of its cleaning angles to an intermediary position substantially in parallel alignment with the longitudinal axis of the handle, at least one compression roller operatively mounted to the sleeve adjacent to the bottom end of the handle so that upon sliding the sleeve towards the bottom of the elongated handle, the base frame pivots to the intermediary position and the compression roller rolls over the sponge element to progressively compress the sponge element against the base frame and wring absorbed fluids from the sponge.

36. The self-wringing mop of claim 35 and further comprising releasable mounting means on the base frame assembly to detachably mount the sponge element and the scrubbing element.

37. The self-wringing mop of claim 35 and further comprising releasable detent means positioned adjacent to the lower end of the handle engaging complementary detent means on the base frame assembly to releasably secure the base frame assembly in at least two positions, one position orienting the sponge element on the surface to be cleaned and the other orienting the scrubbing element on the surface to be cleaned.

38. The self-wringing mop of claim 35 wherein the at least one compression roller is mounted to the sleeve a fixed distance from the lower end of the handle thereby defining a gap between the roller and the handle, and the sponge element is drawn up into the gap for wringing when the sleeve is moved towards the bottom of the elongated handle.

39. The self-wringing mop of claim 35 wherein the sponge element has a forward edge and a rear edge adjacent to the elongated handle, the rear edge presenting an obtuse angle with respect to the longitudinal axis of the handle to allow the at least one compression roller to easily engage and roll over the edge of the sponge element to wring absorbed fluid from the sponge element.

40. The self-wringing mop of claim 35 and further comprising spring means for pivoting the base frame assembly from the intermediary position to one of the cleaning angle positions after the sponge is wrung out.

41. The self-wringing mop of claim 35 wherein the sleeve moves between an initial cleaning position through a sponge wringing position, and the means on the sleeve to engage the base frame for pivoting the base frame engages the base frame only through the sponge wringing position.

42. The self-wringing mop of claim 35 and further comprising a channel on the second side of the base frame, and the means on the sleeve to engage the base frame is a protruding tongue member that slides in the channel.

43. The self-wringing mop of claim 42 wherein the protruding tongue member provides a support for the second side of the base frame during the wringing of the sponge whereby the sponge is compressed between the at least one compression and the first side of the base frame.

44. The self-wringing mop of claim 42 wherein the base frame is wedge-shaped in cross section, with a greater height adjacent the pivotal connection means.

45. A self-wringing mop for cleaning a surface comprising:

an elongated handle having a longitudinal axis and opposite top and bottom ends;

a base frame having two substantially flat planar surfaces on either side of the base frame;

a sponge element positioned on one of the flat planar surfaces;

a scrubber element positioned on the other of the flat planar surfaces;

pivotal connection means along one edge of the base frame for securing the base frame to the bottom end of the elongated handle, the pivotal connection means allowing the base frame to rotate thereabout;

stop means on the base frame to limit the rotation of the base frame about the pivotal connection means to two extremities, one extremity orienting the sponge to the surface to be cleaned and the other extremity orienting the scrubber element to the surface to be cleaned after rotation of the handle 180 degrees about it's longitudinal axis;

a sleeve slidably mounted on the elongated handle for limited lateral movement with respect to the handle;

at least one compression roller operatively connected to the sleeve adjacent to the bottom end for engaging the sponge element for progressively compressing the sponge element and wringing absorbed fluids from the sponge element as the sleeve is moved towards the bottom of the elongated handle.

46. The self-wringing mop of claim 45 and further comprising releasable mounting means on the base frame to detachably mount the sponge element and the scrubber element.

47. The self-wringing mop of claim 45 and further comprising releasable detent means positioned adjacent to the lower end of the handle engaging complementary detent means on the base frame to releasably secure the base frame in at least two positions, one position orienting the sponge element on the surface to be cleaned and the other orienting the scrubber element on the surface to be cleaned.

48. The self-wringing mop of claim 45 wherein the compression roller is mounted to the sleeve a fixed distance from the lower end of the handle thereby defining a gap between the roller and the handle, and the sponge element is drawn up into the gap for wringing when the sleeve is moved towards the bottom of the elongated handle.

49. The self-wringing mop of claim 45 wherein the sponge element has a forward edge and a rear edge adjacent to the elongated handle, the rear edge presenting an obtuse angle with respect to the longitudinal axis of the handle, to allow the roller to easily engage and roll over the edge of the sponge element to wring absorbed fluid from the sponge element.

50. The self-wringing mop of claim 45 and further comprising means on the sleeve to engage the base frame for pivoting the base frame from one of the extremities to a sponge wringing intermediary position between the extremities.

51. The self-wringing mop of claim 50 and further comprising spring means around the pivotal connection means for pivoting the base frame from the sponge wringing position to one of the extremities after the sponge is wrung out.

52. The self-wringing mop of claim 45 and further comprising a channel on the scrubber element side of the planar surface, and the means on the sleeve to engage the base frame is a protruding tongue member that slides in the channel.

53. The self-wringing mop of claim 52 wherein the protruding tongue member provides a support for the base frame during the wringing of the sponge whereby the sponge is compressed between the compression roller and the base frame.

54. The self-wringing mop of claim 45 wherein the base frame is wedge-shaped in cross section, with a greater height adjacent the pivotal connection means.

55. A hand cleaning device for cleaning a surface comprising:

a first cleaning element;

a second cleaning element;

a frame having a first side for supporting the first cleaning element and a second side generally opposite the first side for supporting the second cleaning element;

a handle having an end pivotally connected to the frame to allow the frame to be pivoted from a first position, with the first cleaning element in contact with the surface to be cleaned, to a second position, with the second cleaning element in contact with the surface to be cleaned, by rotating the handle and exerting a force on the handle to cause the frame to pivot from the first position to the second position without the need for the user to touch the frame or cleaning elements, the frame and handle end having mating surfaces that hold the frame in the first or second positions until a force overcomes the holding force to allow the frame to pivot; and a wringing assembly mounted on the handle and moveable along a longitudinal axis of the handle into contact with at least one of the cleaning elements to wring at least the one cleaning element wherein the wringing assembly pivots the frame from either the first position or the second position to a position intermediate the first and second positions as the wringing assembly is moved into contact with the cleaning element for wringing.

56. A hand held cleaning device for cleaning a surface comprising:

a first cleaning element;

a second cleaning element;

a frame having a first side for supporting the first cleaning element and a second side generally opposite the first side for supporting the second cleaning element;

a handle having an end pivotally connected to the frame to allow the frame to be pivoted from a first position, with the first cleaning element in contact with the surface to be cleaned, to a second position, with the second cleaning element in contact with the surface to be cleaned, by rotating the handle and exerting a force on the handle to cause the frame to pivot from the first position to the second position without the need for the user to touch the frame or cleaning elements; and a wringing assembly having at least one roller mounted on the handle and moveable along a longitudinal axis of the handle into contact with at least one of the cleaning elements to wring at least the one cleaning element wherein the wringing assembly pivots the frame to a position intermediate the first and second positions as the wringing assembly is moved into contact with the cleaning element for wringing.

* * * * *